US011283145B2

(12) United States Patent
Oya

(10) Patent No.: US 11,283,145 B2
(45) Date of Patent: *Mar. 22, 2022

(54) VARIABLE ATTENUATOR

(71) Applicant: SUMITOMO ELECTRIC DEVICE INNOVATIONS, INC., Kanagawa (JP)

(72) Inventor: Akio Oya, Yokohama (JP)

(73) Assignee: SUMITOMO ELECTRIC DEVICE INNOVATIONS, INC., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/108,769

(22) Filed: Dec. 1, 2020

(65) Prior Publication Data

US 2021/0083355 A1 Mar. 18, 2021

Related U.S. Application Data

(63) Continuation of application No. 16/440,508, filed on Jun. 13, 2019, now Pat. No. 10,886,587.

(30) Foreign Application Priority Data

Jun. 14, 2018 (JP) ..... JP2018-113524

(51) Int. Cl.
*H01P 1/22* (2006.01)

(52) U.S. Cl.
CPC ..... *H01P 1/227* (2013.01)

(58) Field of Classification Search
CPC .... H01P 1/227; H01P 1/22; H01P 5/12; H01P 5/16; H01P 5/18; H01P 5/183; H01P 5/184; H01P 5/185; H01P 5/187; H03H 11/24; H03H 11/245
USPC ..... 333/81 A, 81 R, 26, 109, 110
See application file for complete search history.

(56) References Cited

U.S. PATENT DOCUMENTS 6,414,565 B1 7/2002 Tanaka
6,480,708 B1 11/2002 Tanaka
7,492,235 B2 2/2009 Vice
(Continued)

FOREIGN PATENT DOCUMENTS

JP S60-114410 8/1985
JP H8-321704 12/1996
(Continued)

OTHER PUBLICATIONS

Notice of Reasons for Refusal issued by the JPO dated Feb. 8, 2022.

*Primary Examiner* — Stephen E. Jones
(74) *Attorney, Agent, or Firm* — Smith, Gambrell & Russell, LLP.

(57) ABSTRACT

A variable attenuator is an attenuator which is formed by coupling two transmission lines having an electrical length of λ/4 corresponding to a wavelength λ of an input signal, has one end of one transmission line as an input terminal, has the other end of the one transmission line as a through terminal, has one end of the other transmission line as a coupling terminal and has the other end of the other transmission line as an output terminal, wherein the variable attenuator has a resistor pair having the same impedance at both the through terminal and the coupling terminal, and has a resistor pair having the same impedance at both the input terminal and the output terminal.

14 Claims, 9 Drawing Sheets

(56) References Cited

U.S. PATENT DOCUMENTS

| | | | | |
|---|---|---|---|---|
| 10,886,587 | B2 * | 1/2021 | Oya | H01P 1/227 |
| 2006/0273863 | A1 | 12/2006 | Quan | |

FOREIGN PATENT DOCUMENTS

| | | |
|---|---|---|
| JP | WO 97/28598 | 7/1997 |
| JP | 2000-507751 | 6/2000 |

* cited by examiner

VARIABLE ATTENUATOR

CROSS REFERENCE TO RELATED APPLICATIONS

This application is a continuation of U.S. application Ser. No. 16/440,508 filed on Jun. 13, 2019 and claims priority therefrom under 35 U.S.C. 120. Application Ser. No. 16/440,508 benefits from priority from Japanese Application 2018-113524 filed on Jun. 14, 2018 under 35 U.S.C. 119.

TECHNICAL FIELD

An aspect of the present invention relates to a variable attenuator for an RF signal.

BACKGROUND

A configuration in which field effect transistors (FETs) 161 and 162 and 50Ω resistors 151 and 152 are connected in parallel to a through terminal and a couple terminal of a 90° coupler is known as a variable attenuator of an RF signal (refer to Patent Document 1: Japanese Unexamined Patent Publication No. 2000-507751). In this circuit, when the FETs 161 and 162 are turned off, a signal transmitted to an input terminal is absorbed by the 50Ω resistors 151 and 152, and an attenuation amount of a signal output from an output terminal (an isolation terminal) is maximized, and when the FETs 161 and 162 are turned on, most of the signal is reflected to the output terminal, and the attenuation amount of the signal output from the output terminal is reduced.

In the circuit described in Patent Document 1, when a resistance value of a variable resistor matches a characteristic impedance of a transmission line constituting a quadrature phase hybrid circuit, an attenuation amount of an output signal becomes maximum. However, the maximum value of the attenuation amount may be insufficient depending on the application. Therefore, a variable attenuation circuit with a sufficiently large attenuation amount is desired.

SUMMARY

A variable attenuator according to an aspect of the present invention is a variable attenuator which is formed by coupling a first transmission line and a second transmission line having an electrical length of λ/4 corresponding to a wavelength λ of an input signal, has one end of the first transmission line as an input terminal, has the other end of the first transmission line as a through terminal, has one end of the second transmission line as a coupling terminal and has the other end of the second transmission line as an output terminal, wherein the variable attenuator has two first resistance elements having the same impedance at both the through terminal and the coupling terminal, and has two second resistance elements having the same impedance at both the input terminal and the output terminal.

DETAILED DESCRIPTION

Hereinafter, embodiments of the present invention will be described with reference to the drawings. In the description of the drawings, the same elements will be designated by the same reference symbols, and redundant description will be omitted.

[Configuration of Variable Attenuator]

Figure 1:
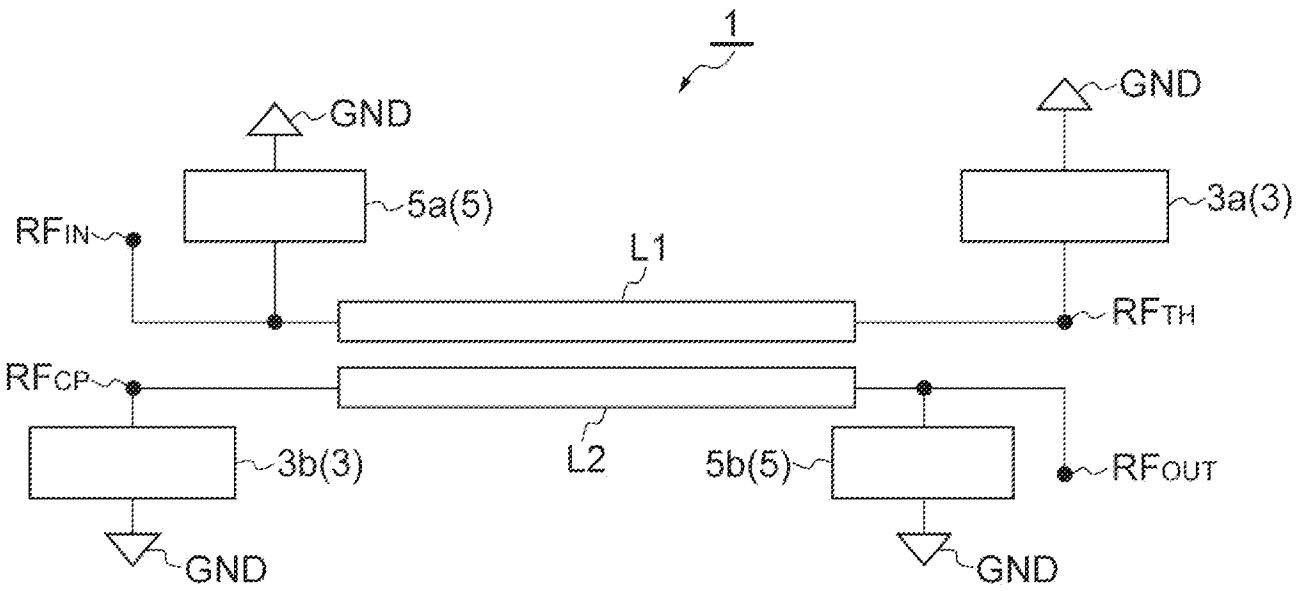
FIG. 1 is a circuit diagram of a variable attenuator according to an embodiment.

FIG. 1 is a circuit diagram of a variable attenuator according to an embodiment. The variable attenuator 1 shown in FIG. 1 is a circuit which attenuates and outputs an input signal (for example, a high frequency signal of 15 to 25 GHz) in an RF band. The variable attenuator 1 includes two transmission lines L1 and L2 coupled to each other, a resistor pair 3 including two resistance elements 3*a* and 3*b*, and a resistor pair 5 including two resistance elements 5*a* and 5*b*.

Each of the two transmission lines L1 and L2 is configured with a linear pattern and has an electrical length of λ/4 corresponding to a wavelength λ of an input signal. The two transmission lines L1 and L2 are coupled to each other over a portion of the electrical length λ/4. One end of the transmission line L1 is electrically connected to an input terminal $RF_{IN}$, and the other end is electrically connected to a through terminal $RF_{TH}$. Additionally, one end of the transmission line L2 coupled to the transmission line L1 is electrically connected to a coupling terminal $RF_{CP}$, and the other end of the transmission line L2 is electrically connected to an output terminal $RF_{OUT}$. The output terminal $RF_{OUT}$ may be called an isolation terminal. In such a configuration, an input signal input from the input terminal $RF_{IN}$ is transmitted from the transmission line L1 side to the transmission line L2 side, and an output signal is generated at the output terminal $RF_{OUT}$.

The resistance elements 3*a* and 3*b* have the same resistance value and are provided between the through terminal $RF_{TH}$ and the coupling terminal $RF_{CP}$ and a ground GND. The resistance elements 5*a* and 5*b* have the same resistance value and are provided between the input terminal $RF_{IN}$ and the output terminal $RF_{OUT}$ and the ground GND.

Figure 2:
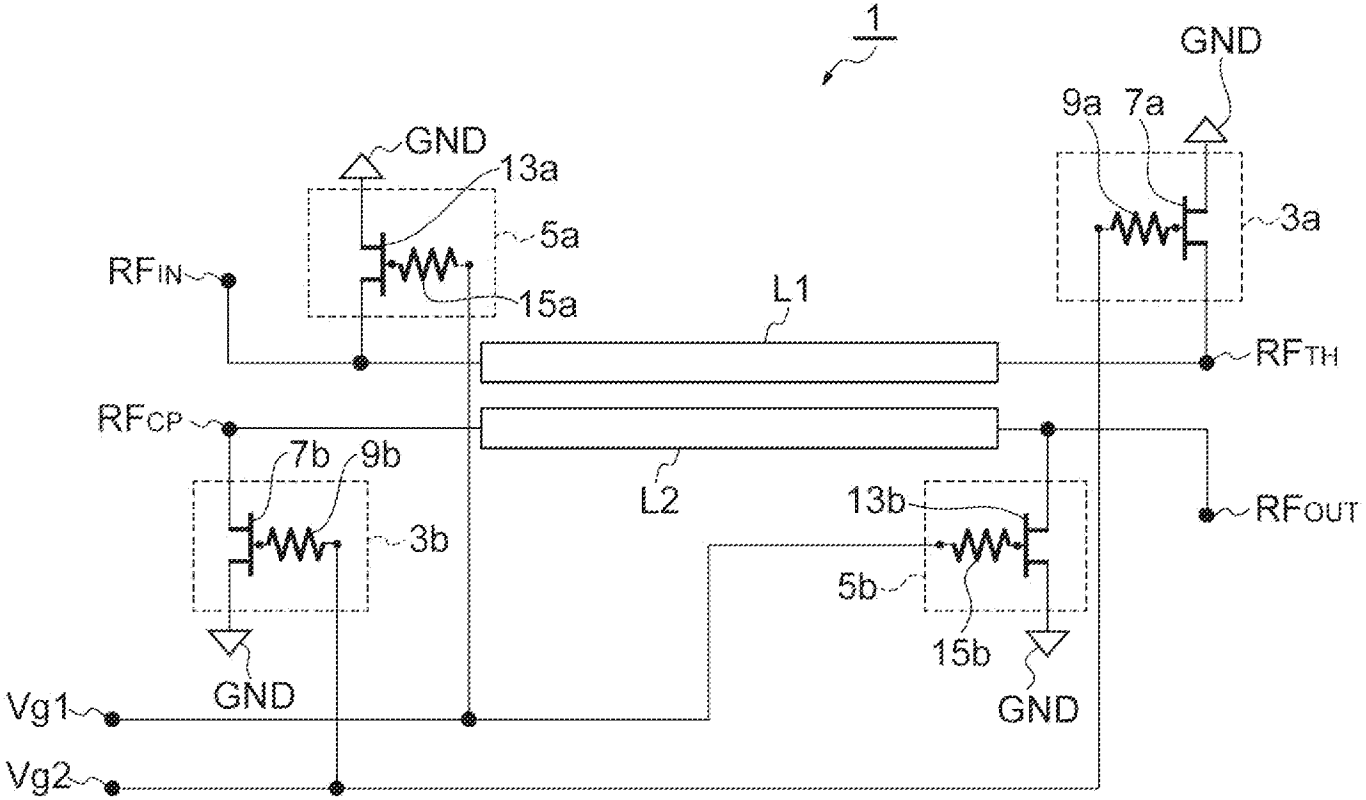
FIG. 2 is a circuit diagram showing a detailed configuration of the variable attenuator of FIG. 1.

FIG. 2 shows a specific circuit configuration of the resistor pairs 3 and 5. As shown in FIG. 2, each of the resistor pairs 3 and 5 is configured by transistors.

Specifically, the resistance element 3*a* includes an FET 7*a* and a resistor 9*a*. A drain which is one terminal of the FET 7*a* is connected to the through terminal $RF_{TH}$, a source which is the other terminal of the FET 7*a* is connected to the ground GND, and a gate which is a control terminal of the FET 7*a* is connected to a control terminal Vg2 via the resistor 9*a*. Thus, the gate of the FET 7*a* receives a control signal supplied to the control terminal Vg2.

Similarly, the resistance element 3*b* includes an FET 7*b* and a resistor 9*b*. A drain which is one terminal of the FET 7*b* is connected to the coupling terminal $RF_{CP}$, a source which is the other terminal of the FET 7*b* is connected to the ground GND, and a gate which is a control terminal of the FET 7*b* is connected to the control terminal Vg2 via the resistor 9*b*. Thus, as in the FET 7*a*, the gate of the FET 7*b* receives a control signal supplied to the control terminal Vg2.

The FETs 7*a* and 7*b* constituting the resistor pair 3 have substantially the same electrical characteristics. Therefore, the resistance values of the resistance elements 3*a* and 3*b* can be changed while maintaining the same value by adjusting the control signal supplied to the control terminal Vg2.

The resistance element 5*a* includes an FET 13*a* and a resistor 15*a*. A drain which is one terminal of the FET 13*a* is connected to the input terminal $RF_{IN}$, a source which is the other terminal of the FET 13*a* is connected to the ground GND, and a gate which is a control terminal of the FET 13*a* is connected to a control terminal Vg1 via the resistor 15*a*. Thus, the gate of the FET 13*a* receives the control signal supplied to the control terminal Vg1.

Similarly, the resistance element 5*b* is configured to include an FET 13*b* and a resistor 15*b*. A drain which is one terminal of the FET 13*b* is connected to the output terminal $RF_{OUT}$, a source which is the other terminal of the FET 13*b* is connected to the ground GND, and a gate which is a control terminal of the FET 13*b* is connected to the control terminal Vg1 via the resistor 15*b*. Thus, the gate of the FET 13*b* receives the control signal supplied to the control terminal Vg1.

The FETs 13*a* and 13*b* constituting the resistor pair 5 have substantially the same electrical characteristics. Therefore, the resistance values of the resistance elements 5*a* and 5*b* can be changed while being set to the same value by adjusting the control signal supplied to the control terminal Vg1.

Here, the resistor pairs 3 and 5 may be set to have the same resistance value by setting the electric characteristics of the FETs 7*a* and 7*b* and the electric characteristics of the FETs 13*a* and 13*b* to be the same, setting the resistance values of the resistors 9*a* and 9*b* and the resistance values of the resistors 15*a* and 15*b* to be the same and making the control signals supplied to the control terminal Vg1 and the control terminal Vg2 the same. On the other hand, the resistance values of the resistor pair 3 and the resistor pair 5 may be set to be different from each other by making the control signals supplied to the control terminal Vg1 and the control terminal Vg2 different from each other.

Figure 3A:
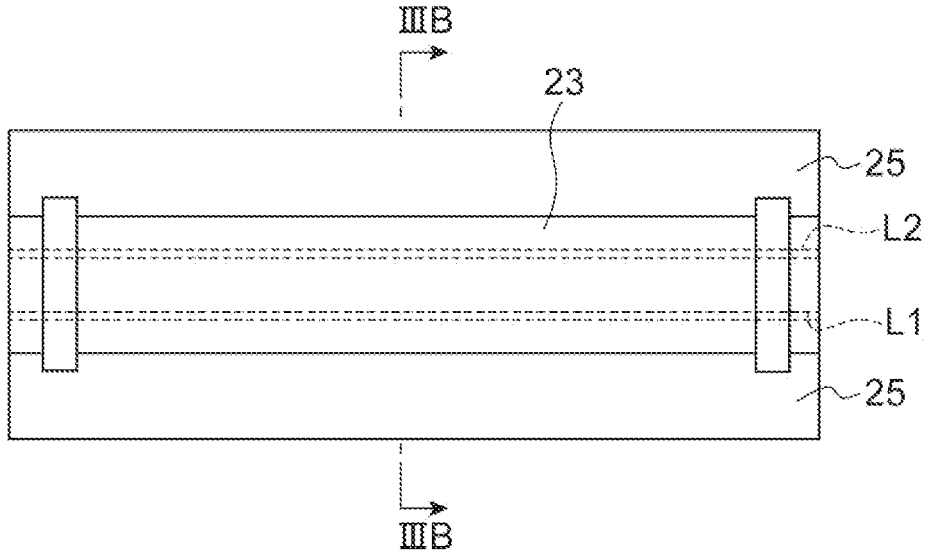
FIG. 3A is a plan view showing a configuration of transmission lines L1 and L2 formed on a circuit board.

A configuration example of the transmission lines L1 and L2 will be described with reference to FIGS. 3A and 3B. FIG. 3A is a plan view of the transmission lines L1 and L2 formed on the circuit board, and FIG. 3B is a cross-sectional view taken along line IIIB-IIIB shown in FIG. 3A.

Figure 3B:
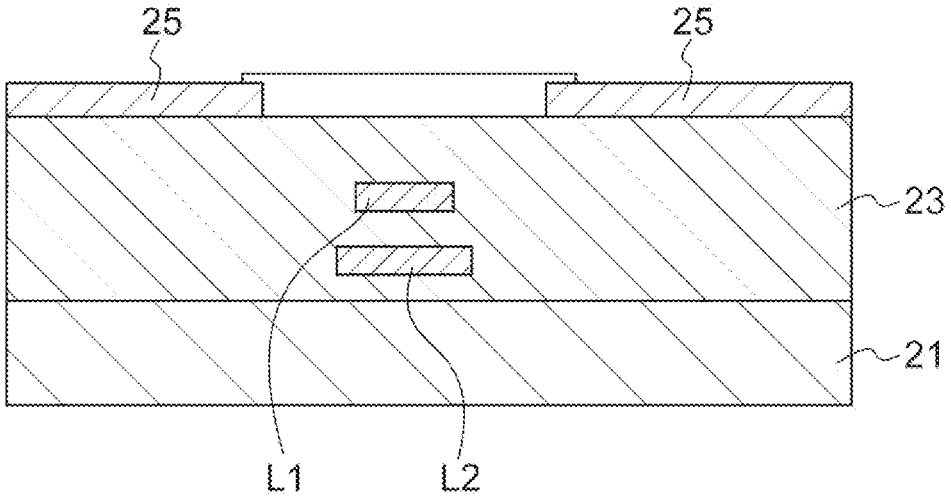
FIG. 3B is a cross-sectional view of the circuit board shown in FIG. 3A along line IIIB-IIIB.

As shown in FIGS. 3A and 3B, the transmission lines L1 and L2 are formed inside, for example, an insulating layer 23 formed of polyimide or the like and formed on a semiconductor substrate 21 such as a GaAs substrate having a predetermined thickness (for example, 250 μm). For example, the transmission line L2 is formed of a metal (gold or the like) and formed linearly along the semiconductor substrate 21 to have a thickness of 1 μm and a width of 12 μm on the semiconductor substrate 21 side in the insulating layer 23. The transmission line L1 is formed of a metal and formed linearly to have a thickness of 1 μm and a width of 9 μm on the opposite side of the transmission line L2 with respect to the semiconductor substrate 21 in the insulating layer 23. The transmission line L1 and the transmission line L2 form a combining portion (a coupling portion) overlapping each other in parallel with a length of λ/4.

Further, a ground layer 25 which is spaced apart from upper portions of the transmission lines L1 and L2, extends parallel to the transmission lines L1 and L2 and is formed of a metal (for example, gold) having a predetermined thickness (for example, 2 μm or more) is formed on the outermost surface of the insulating layer 23. The transmission lines L1 and L2 have a gap of 2 μm therebetween, and a degree of coupling between the transmission lines L1 and L2 is determined by the gap and a dielectric constant of the insulating layer filling the gap. The width of the transmission line L1 is made narrower than a width of the transmission line L2 in order to widen the width of the transmission line L2 (to narrow the width of the transmission line L1) and to equalize the degree of coupling of both the transmission lines L1 and L2 with the ground layer 25, and this is because a distance between the ground layer 25 and the transmission line L1 is narrow and thus the degree of coupling of the transmission line L1 with the ground becomes larger than that of the other transmission line L2. In addition, a region of the ground layer 25 overlapping the transmission lines L1 and L2 is also removed in order to equalize the degree of coupling of the transmission lines L1 and L2 with the ground layer 25 by providing the removal region without making the widths of the two transmission lines L1 and L2 largely different, and this is because, when the ground layer is provided on the entire surface without removing the region and the degree of coupling of the transmission line L1 and the transmission line L2 with the ground layer 25 is made equal, the width of the upper transmission line L1 becomes too narrow.

According to the variable attenuator 1 according to the embodiment, the impedance of the resistor pair 3 provided on the through terminal $RF_{TH}$ and the coupling terminal $RF_{CP}$ can be changed. Furthermore, the impedance of the resistor pair 5 provided on the input terminal $RF_{IN}$ and the output terminal $RF_{OUT}$ can be changed by changing. Specifically, when the resistance values (the impedances) of the resistor pairs 3 and 5 are matched to a characteristic impedance of one of the transmission lines L1 and L2 which is respectively connected thereto, reflection of signals is minimized. On the other hand, as the respective resistance values (the impedances) deviate from the characteristic impedance of the one of the transmission lines L1 and L2, the reflection of signals increases due to the impedance mismatch. As a result, the attenuation amount of the signal output from the output terminal $RF_{OUT}$ can be changed.

In the embodiment, the attenuation amount can be increased by providing the resistor pair 5 in addition to the resistor pair 3. Further, since the resistance elements 5*a* and 5*b* constituting the resistor pair 5 are set to have the same resistance value, the attenuation operation of the attenuator 1 can be stabilized.

In particular, in the embodiment, control signals received at control terminals of a transistor pair included in the resistor pair 3 and a transistor pair included in the resistor pair 5 are set to be the same, and thus resistance values between terminals of transistors are matched to each other. Thus, the maximum attenuation amount can be increased. Furthermore, when the control signals received at the control terminals of the transistor pair included in the resistor pair 3 and the transistor pair included in the resistor pair 5 are set to match each other, the maximum attenuation amount can also be further increased.

Hereinafter, the measurement result of the characteristic of the variable attenuator 1 will be shown.

Figure 4:
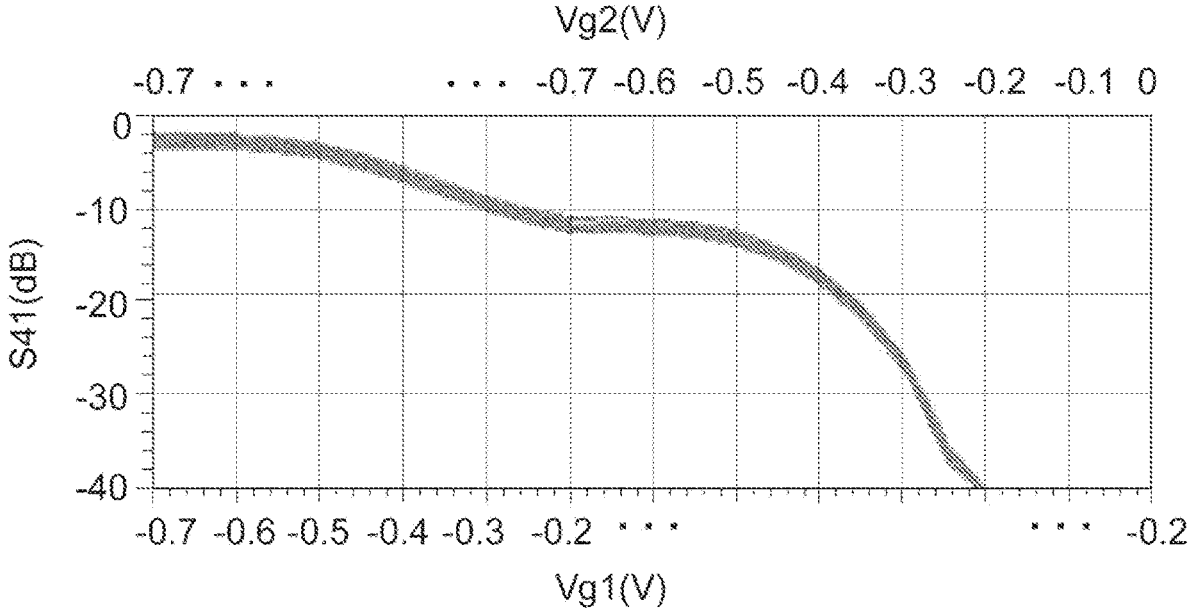
FIG. 4 is a graph showing measurement results of an S parameter (S41) in the embodiment.

FIG. 4 shows an S parameter (S41, the attenuation amount) corresponding to a strength of a signal from the input terminal $RF_{IN}$ to the output terminal $RF_{OUT}$ when the control signals applied to the control terminal Vg1 and the control terminal Vg2 are independently changed. Here, a frequency is swept in a region of 15 to 25 GHz. When the control signal applied to the control terminal Vg2 is fixed at −0.7 V and the control signal applied to the control terminal Vg1 is changed in a range of −0.7 V to −0.2 V, the attenuation amount can be about −10 dB. Further, when the control signal given to control terminal Vg1 is fixed at −0.2 V which is an upper limit value and the control signal given to control terminal Vg2 is changed in the range of −0.7 V to −0.2 V, the attenuation amount can be further increased to −40 dB.

Figure 5D:
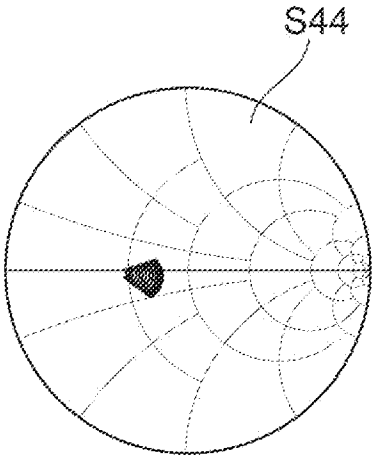
FIG. 5D is a view showing the measurement results of the input/output impedance in the embodiment.
Figure 5C:
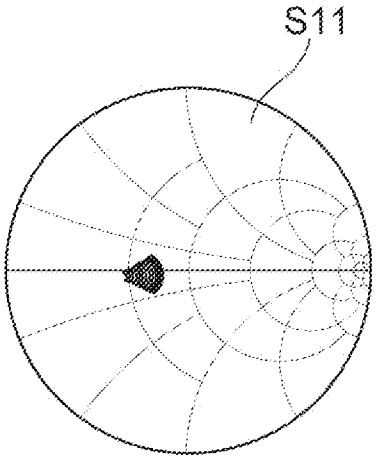
FIG. 5C is a view showing the measurement results of the input/output impedance in the embodiment.
Figure 5B:
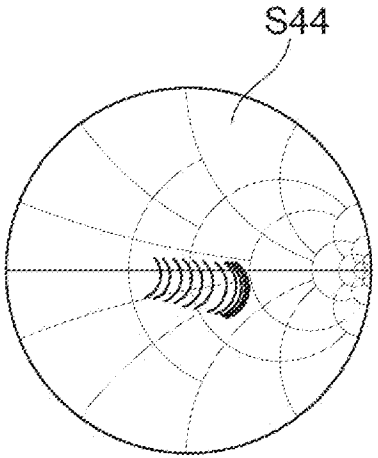
FIG. 5B is a view showing the measurement results of the input/output impedance in the embodiment.
Figure 5A:
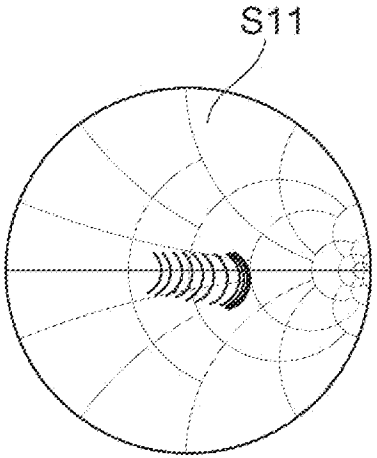
FIG. 5A is a view showing measurement results of input/output impedance in the embodiment.

Further, FIGS. 5A to 5D show S parameters (S11 and S44) corresponding to an input impedance and an output impedance which correspond to the measurement results shown in FIG. 4. FIGS. 5A and 5B respectively show S11 and S44 when the control signal given to the control terminal Vg2 is fixed and the control signal given to the control terminal Vg1 is changed, and FIGS. 5C and 5D respectively show S11 and S44 when the control signal given to the control terminal Vg1 is fixed to the upper limit value and the control signal given to the control terminal Vg2 is changed. As described above, when the control signal supplied to the control terminal Vg1 is changed, the input impedance and the output impedance change slightly, but an amount of change is within an allowable range. On the other hand, when the control signal applied to the control terminal Vg2 is changed, the fluctuation of the input impedance and the output impedance is suppressed to a small value.

Figure 6:
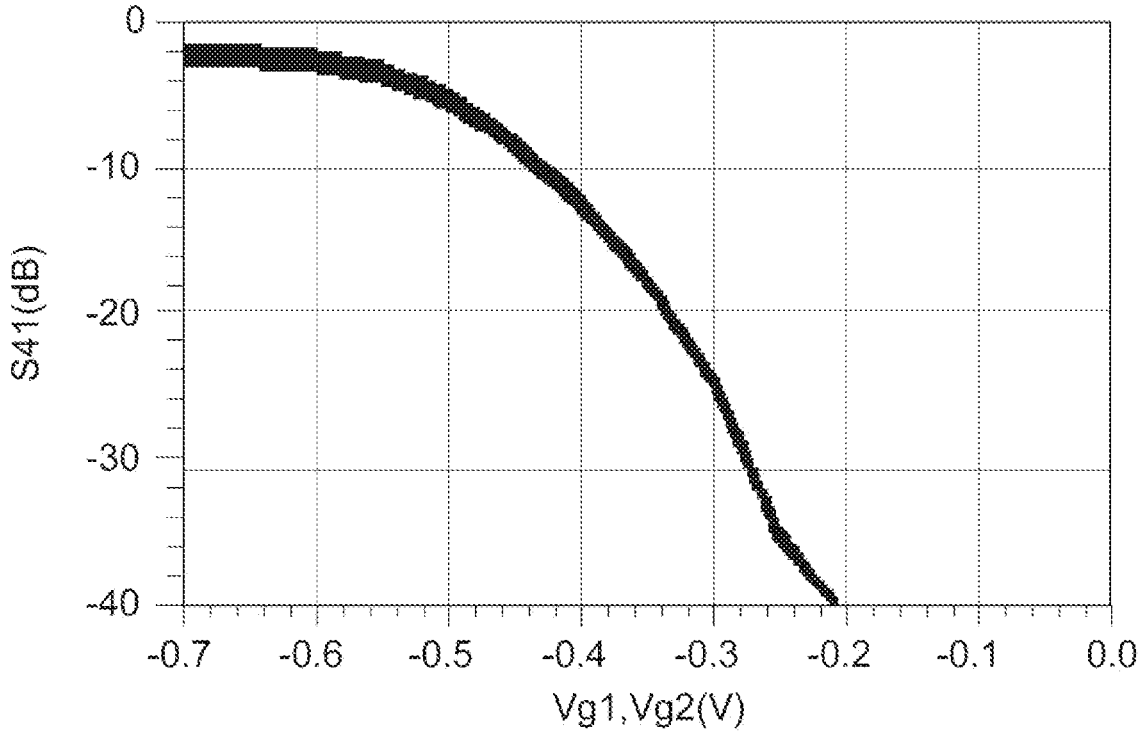
FIG. 6 is a graph showing the measurement results of the S parameter (S41) in the embodiment.

FIG. 6 shows S41 when the control signal applied to the control terminal Vg1 and the control signal applied to the control terminal Vg2 are simultaneously and similarly changed. As the figure shows, the attenuation amount can be set as large as −40 dB by changing the signals applied to the control terminals Vg1 and Vg2 similarly in the range of −0.7 V to −0.2 V.

Figure 7A:
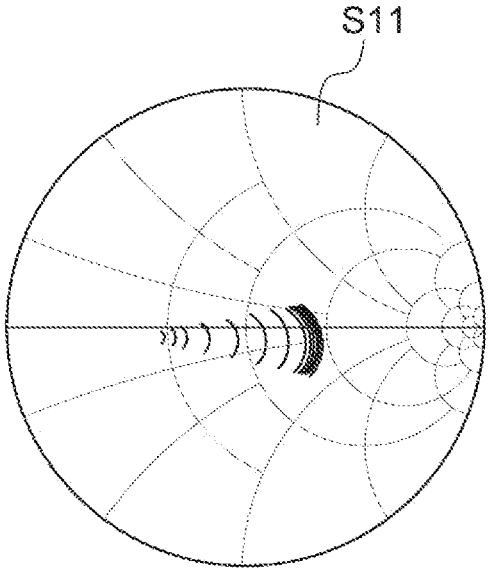
FIG. 7A is a view showing the measurement results of the input impedance in the embodiment.
Figure 7B:
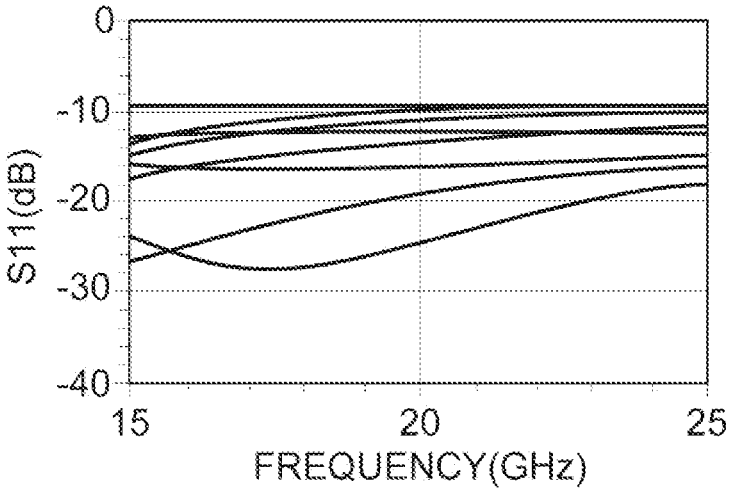
FIG. 7B is a graph showing measurement results of an S parameter (S11) in the embodiment.
Figure 8A:
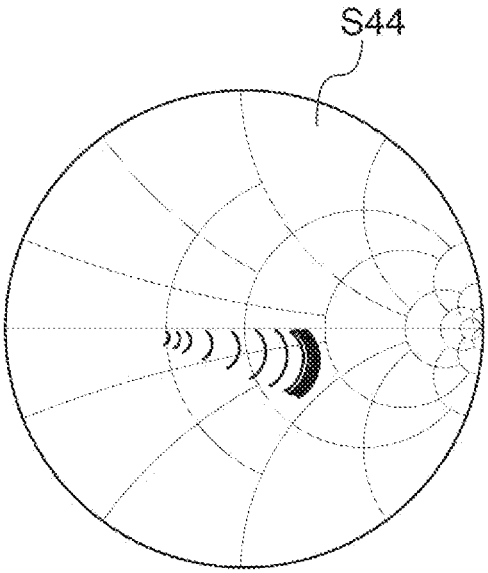
FIG. 8A is a view showing the measurement results of the output impedance in the embodiment.
Figure 8B:
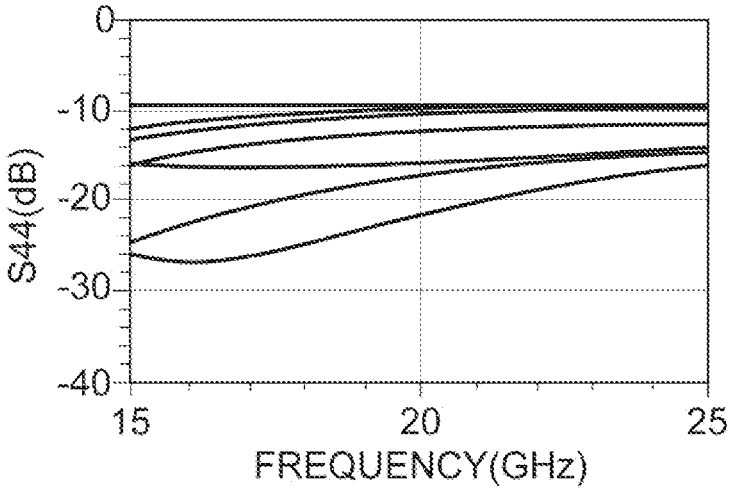
FIG. 8B is a graph showing measurement results of an S parameter (S44) in the embodiment.

Further, FIGS. 7A, 7B, 8A and 8B show results of evaluation of the input impedance (S11) and the output impedance (S44) of the attenuator 1 in the frequency range of 15 to 25 GHz using the control signals given to the control terminals Vg1 and Vg2 as parameters. In the present invention, a desired attenuation amount is obtained by inserting the resistor pair 5 into the input terminal $RF_{IN}$ and the output terminal $RF_{OUT}$, and by changing an equivalent impedance thereof. As a result, when the input/output impedance largely deviates from the characteristic impedance, transmission characteristics of circuits connected to a front stage and a rear stage of the attenuator deteriorate. FIGS. 7A and 8A show S11 and S44 in a Smith chart, and FIGS. 7B and 8B show values of S11 and S44. As the figures shows, although the input impedance and the output impedance are affected by the signals applied to control terminals Vg1 and Vg2, that is, the presence of the resistor pair 5, the impedance matching between the input and the output does not greatly change because both impedances change similarly. In addition, the return is suppressed to about −10 dB in a wide range of 15 to 25 GHz of the frequency of the input signal.

While the principles of the present invention have been illustrated and described in the preferred embodiment, it will be appreciated by those skilled in the art that the present invention can be modified in arrangement and detail without departing from such principles. The present invention is not limited to the specific configuration disclosed in the embodiment. Therefore, all modifications and changes coming from the scope of claims and the scope of the spirit thereof will be claimed.

Figure 9:
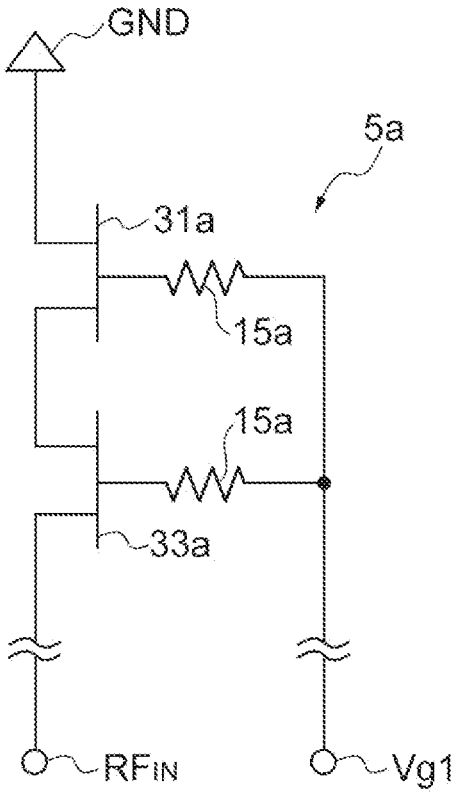
FIG. 9 is a circuit diagram showing another configuration example of a resistor 5*a* of FIG. 1.

For example, the configurations of the resistor pairs 3 and 5 included in the variable attenuator 1 of the above-described embodiment can be variously changed. FIG. 9 shows another configuration example of the resistance element 5*a*. The same configuration can be adopted for the other resistance element 3*a*.

The resistance element 5*a* shown in FIG. 9 includes at least two FETs 31*a* and 33*a* connected in series between input terminal $RF_{IN}$ and the ground GND and having the same electrical characteristics as each other. Additionally, in each of the two FETs 31*a* and 33*a*, the control signal is supplied from the control terminal Vg1 to the control terminal via the resistor 15*a*. The resistance element 5*b* also has the same configuration. According to such a modified example, when the strength of the input signal is high, the power applied to one stage of the transistors connected in series can be reduced. As the result, a breakdown of the transistor can be prevented and distortion of the signal line can be reduced by distributing the applied voltage.

What is claimed is:

1. A variable attenuator comprising:

a first transmission line and a second transmission line having an electrical length of λ/4 corresponding to a wavelength λ of an input signal and coupled to each other;

an input terminal provided at one end of the first transmission line;

a through terminal provided at the other end of the first transmission line;

a coupling terminal provided at one end of the second transmission line;

an output terminal provided at the other end of the second transmission line;

a first resistance element connected between the input terminal and a ground, includes a first transistor having a first control terminal, a second resistance element connected between the output terminal and the ground, includes a second transistor having a second control terminal, a third resistance element connected between the through terminal and the ground, includes a third transistor having a third control terminal, and a fourth resistance element connected between the coupling terminal and the ground, includes a fourth transistor having a fourth control terminal, wherein the first control terminal receives a first control signal, the second control terminal receives a second control signal, the third control terminal receives a third control signal, and the fourth control terminal receives a fourth control signal.

2. The variable attenuator according to claim 1, wherein the third control signal and the fourth control signal are the same signal.

3. The variable attenuator according to claim 1, wherein the first control signal and the second control signal are the same signal.

4. The variable attenuator according to claim 3, wherein the third control signal and the fourth control signal are the same signal.

5. The variable attenuator according to claim 4, wherein the first control signal and the third control signal are the same signal.

6. The variable attenuator according to claim 4, wherein the first control signal and the third control signal are different signals.

7. The variable attenuator according to claim 1, wherein the first resistance element includes a plurality of transistors connected in series between the input terminal and the ground.

8. The variable attenuator according to claim 7, wherein control terminals of the transistors of the first resistance element receive the first control signal.

9. The variable attenuator according to claim 1, wherein the second resistance element includes a plurality of transistors connected in series between the output terminal and the ground.

10. The variable attenuator according to claim 9, wherein control terminals of the transistors of the second resistance element receive the second control signal.

11. The variable attenuator according to claim 1, wherein the third resistance element includes a plurality of transistors connected in series between the through terminal and the ground.

12. The variable attenuator according to claim 11, wherein control terminals of the transistors of the third resistance element receive the third control signal.

13. The variable attenuator according to claim 1, wherein the fourth resistance element includes a plurality of transistors connected in series between the coupling terminal and the ground.

14. The variable attenuator according to claim 13, wherein control terminals of the transistors of the fourth resistance element receive the fourth control signal.

* * * * *